US007318771B2

(12) United States Patent
Huang et al.

(10) Patent No.: US 7,318,771 B2
(45) Date of Patent: Jan. 15, 2008

(54) AIR-ISOLATOR FUME HOOD

(75) Inventors: Rong Fung Huang, Taipei (TW); Yu-Kang Chen, Guelren Township, Tainan County (TW); Tung-Sheng Shih, Shijr (TW); Cheng-Ping Chang, Shijr (TW); Chun-Wan Chen, Shijr (TW); Yi-Ta Wu, Taipei (TW); Hung-Ta Chen, Taipei (TW)

(73) Assignee: Institute of Occupational Safety and Health, Council of Labor Affairs, Taipei (TW)

( * ) Notice: Subject to any disclaimer, the term of this patent is extended or adjusted under 35 U.S.C. 154(b) by 0 days.

(21) Appl. No.: 11/183,791

(22) Filed: Jul. 19, 2005

(65) Prior Publication Data

US 2007/0021047 A1 Jan. 25, 2007

(51) Int. Cl.
*B08B 15/02* (2006.01)

(52) U.S. Cl. ..... 454/61

(58) Field of Classification Search ..... 454/51, 454/56, 58, 67, 60

See application file for complete search history.

(56) References Cited

U.S. PATENT DOCUMENTS

| | | | | |
|---|---|---|---|---|
| 3,256,799 | A * | 6/1966 | Sterling et al. | 454/190 |
| 3,318,227 | A * | 5/1967 | Nelson et al. | 454/59 |
| 4,100,847 | A * | 7/1978 | Norton | 454/57 |
| 5,215,497 | A * | 6/1993 | Drees | 454/61 |
| 6,428,408 | B1 * | 8/2002 | Bell et al. | 454/56 |

* cited by examiner

*Primary Examiner*—Steven McAllister
*Assistant Examiner*—Helena Kosanovic
(74) *Attorney, Agent, or Firm*—Troxell Law Office, PLLC

(57) ABSTRACT

The present invention is a fume hood capable of exhausting contaminant, having an air pipe in a sash and a suction slot corresponding to the air pipe deposed at the front rim of the bottom surface to obtain an air curtain, where contaminant is efficiently prevented from leakage and energy is saved.

7 Claims, 10 Drawing Sheets

AIR-ISOLATOR FUME HOOD

FIELD OF THE INVENTION

The present invention relates to a fume hood; more particularly, relates to dynamically combining a sash having an air pipe, and an exhaust outlet having a suction slot, corresponding to the air pipe, deposed at the front rim of the bottom surface, where, by deposing a screen on top of the fume hood, a physical mechanism of air exhaust together with air supply is obtained; and an air curtain is obtained between the air pipe and the suction slot to prevent contaminant from leakage while exhausting air locally near the contaminant source, so that energy can be saved and the contaminant can be exhausted and prevented from leakage, which can be applied in some processes for producing semiconductors (such as photoresist etching, crystal furnace cleansing, etc.) or be applied in a laboratory or a similar construction.

DESCRIPTION OF THE RELATED ARTS

A hood is a main part for a local exhauster, which mainly exhausts contaminant gases into a local exhausting pipe. To fit in with working environments, there are many types of hoods, such as the close type, the booth type, the by-pass type, the push-suction type, etc. Therein, the close-type hood has the best trapping effect while preventing influence from the outside environment. But the close-type hood is totally closed and so may do harms to the on-site workers. So, this kind of hood is used only in harmful or highly dangerous working environments. Instead, a booth-type hood is usually used in an environment required of higher protection, which contains close surfaces except a surface left to be opened to the outside. In general, its protection effect and trapping effect are better than those of the other non-close type hood; and its performance is not influenced by the outside environment.

The booth-type hoods are most often found as chemical fume hoods in laboratories. Some manufacturing processes in the semiconductor industry, such as photo resist etching, crystal furnace clean sing, etc., are run in chemical fume hoods. By the development of the biotechnology, laboratory biohazards have gained more and more attention. The biosafety cabinets used in microbiology laboratories are also basically a booth-type hood. In general, a booth-type hood is used in an environment with higher protection requirement and concept.

When comparing to a by-pass type hood, a general booth-type hood comprises a hood surrounding with an exhaust hole or suction slot; and, if in need, with baffles to distribute air evenly. A better booth-type hood may even depose a device for supplying air. Nevertheless, both of the chemical fume hood and the biosafety cabinet each has a sliding door to control the area of opening.

The ultimate goal for deposing a booth-type hood is to prevent the pernicious objects from escaping outside. Yet, in actual operations, pernicious objects may escape sometimes. The reasons may be concluded into three categories as follows:

1. Lacking most appropriate design: such as being short in air suction, improperly positioning suction slot, inappropriately locating air supply, unevenly distributing air velocity at an opening, unfavorably designing edges at the opening, etc.;

2. Not operating under the best situation: such as too much pernicious objects released, inner pernicious objects rapidly escaping toward the opening, too big movement of operation from the inside to the outside, over wide-opened sliding door, air suction lack of examination when operating, etc.; and 3. Maintaining improperly: such as breakage of the booth wall or the pipe, malfunction or disability of the exhausting device, etc.

Furthermore, besides preventing the pernicious objects from polluting environment and infecting people by escaping outside, in some industries, such as the semiconductor industry and the biotechnology industry, preventing samples in the hood from being polluted by the air outside has to be considered too. Thereby, the design and the function evaluation for the hood be come harder.

A fume hood in Renaissance discharged harmful gas out of the room through a chimney by utilizing heat convection effect. At that time, the building technology of the chimney was not perfect until the development of computational fluid dynamics (CFD), which developed a technology of utilizing high altitude side-wind flow. By such a technology, a local low pressure is formed in the chimney to help carrying out the flow inside. The later fume hood was following the original chimney design except adding an exhaust fan to carry air flow flow out with an enforced convection.

Conventional fume hoods use exhaust fans to carry harmful gas out, which can be divided into two categories, CAV (constant volume air volume) and VAV (variable volume air volume).

Please refer to FIG. 9 and FIG. 10, which are a front view and a cross-sectional view according to a prior art. As shown in the figures, a chemical fume hood has a fume hood 81, comprising a baffle 82 with a turning angle near the exhausting opening and three slots 83 on the baffle 82 to help exhausting air. At the bottom of the baffle 82, a gap is located between the baffle 82 and the wall of the fume hood 81. The exhausting opening at the top of the fume hood 81 is connected with a Venturi tube to the outside through an air shaft of PP (Polypropylene) plastic. In the end a blower 84 is used to exhaust air. The main purpose for the fume hood 81 is to exhaust the harmful output of a chemical reaction. So, before the reaction begins, the blower has to be turned on to blow air. At his time, the sash 85 should not be shut completely; or, the blower would be in idle running or even worn our when the sash 85 is shut completely without any mechanism of air supply. When an operator reaches his hand into the hood for an operation, the sash 85 is opened to a required height, where the harmful output in the hood does not escape outside even with the mechanism of the air exhausting in the hood. Yet, for the fume hood is not designed from a viewpoint of CFD to improve its structure and the flow fields inside, the flow fields inside the fume hood according to the prior art comprise obvious big circulations no matter how high or how low the opening height of the sash 85 is. And, when the opening height is getting lower, the circulations are getting bigger. In addition, because the circulations stay close to the sash 85, the harmful output may escape outside following the stirring of the circulations by mixing into them. Circulations may occur not only near the sash, they may occur near the chest of an operator. The circulations near the chest of the operator are just like those occurred after air passing through an obtuse object; and the harmful output may be mixed into the circulations to make the density of the harmful output near the chest of the operator become higher.

The problems with the above fume hoods are owing to the lack of considering the flow field structure of CFD. So, the refinements to the structure of the fume hood according to the prior art, such as the refinements to baffle, blower, sash and wall, do not benefit much to prevent circulations in the flow fields or to prevent the harmful output from leakage. These refinements may cost a lot yet the results are much in doubt. So, the prior arts do not fulfill users' requests on actual use.

SUMMARY OF THE INVENTION

Therefore, the main purpose of the present invention is to dynamically combine a sash with a fume hood, where the sash has an air pipe and the fume hood has an exhaust outlet deposed at the front rim of the bottom surface with a suction slot corresponding to the air pipe so that an efficient local air-suction near a contaminant source is obtained to exhaust pernicious gases while saving energy.

Another purpose of the present invention is to depose a screen on the top of the fume hood to obtain a mechanism of air suction together with air supply to quickly exhaust pernicious gases while saving energy.

To achieve the above purposes, the present invention is an air-isolator fume hood, comprising a hood, a sash, an exhaust outlet, a blower and a screen. Therein, the hood has a containing space to contain pernicious gases to be exhausted, and accessible spaces at the top surface and the side surface; the sash having an air pipe is dynamically combined with the hood at a side with the opening height controlled; the exhaust outlet with a suction slot corresponding to the air pipe is deposed at the front bottom rim of the hood; the blower is deposed at an exit end of the exhaust outlet for exhausting pernicious gases; and, the screen is deposed on the top of the hood to supply air. Accordingly, an air-isolator fume hood is obtained with a mechanism of air suction and air supply to save energy while locally exhausting pernicious gases near a contaminant source; and an air curtain is obtained to efficiently prevent contaminant from leakage.

BRIEF DESCRIPTION OF THE DRAWINGS

The present invention will be better understood from the following detailed description(s) of the preferred embodiment(s) according to the present invention, taken in conjunction with the accompanying drawings, in which.

DESCRIPTION OF THE PREFERRED EMBODIMENTS

Figure 1:
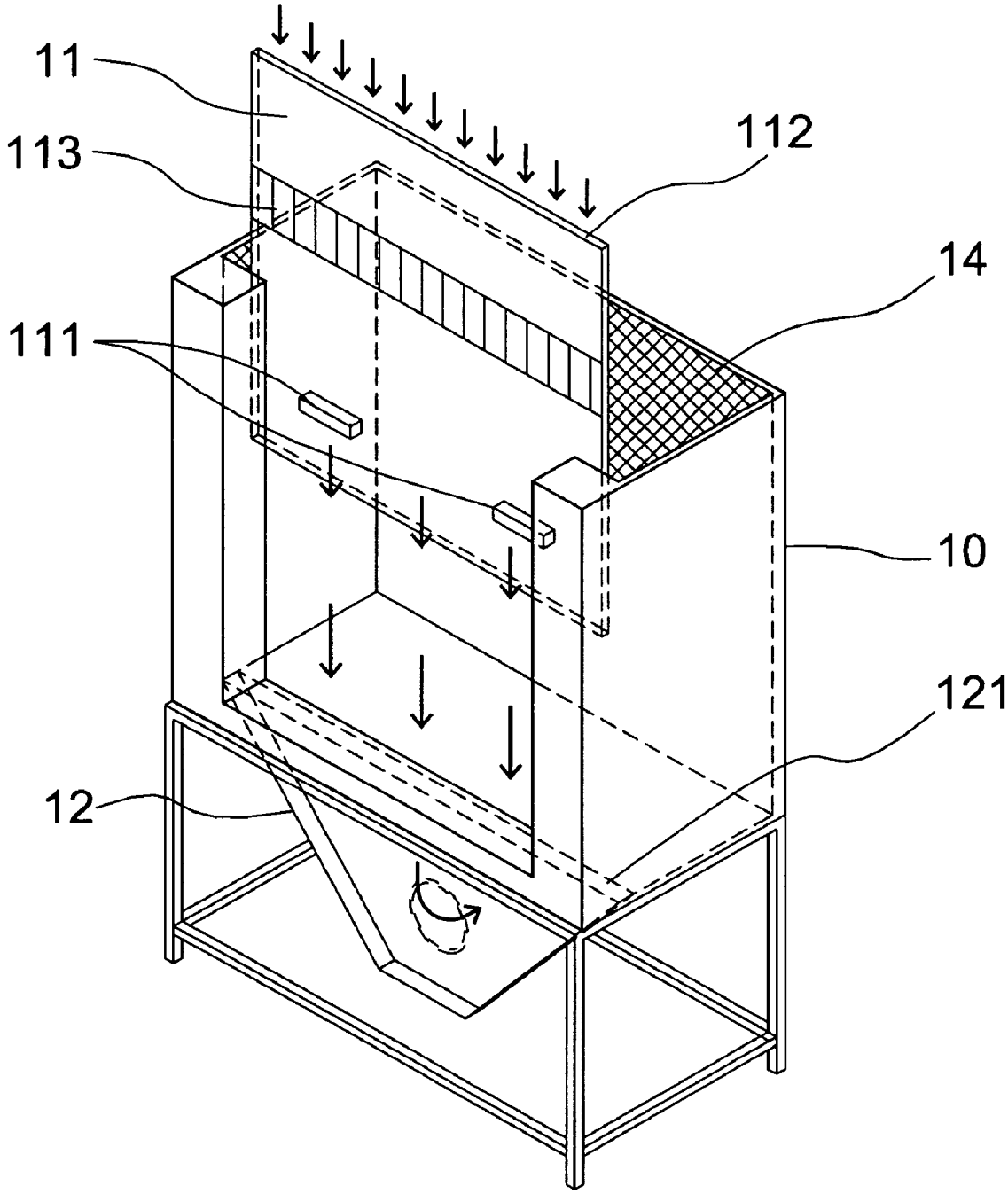
FIG. 1 is a perspective view showing a preferred embodiment according to the present invention.
Figure 2:
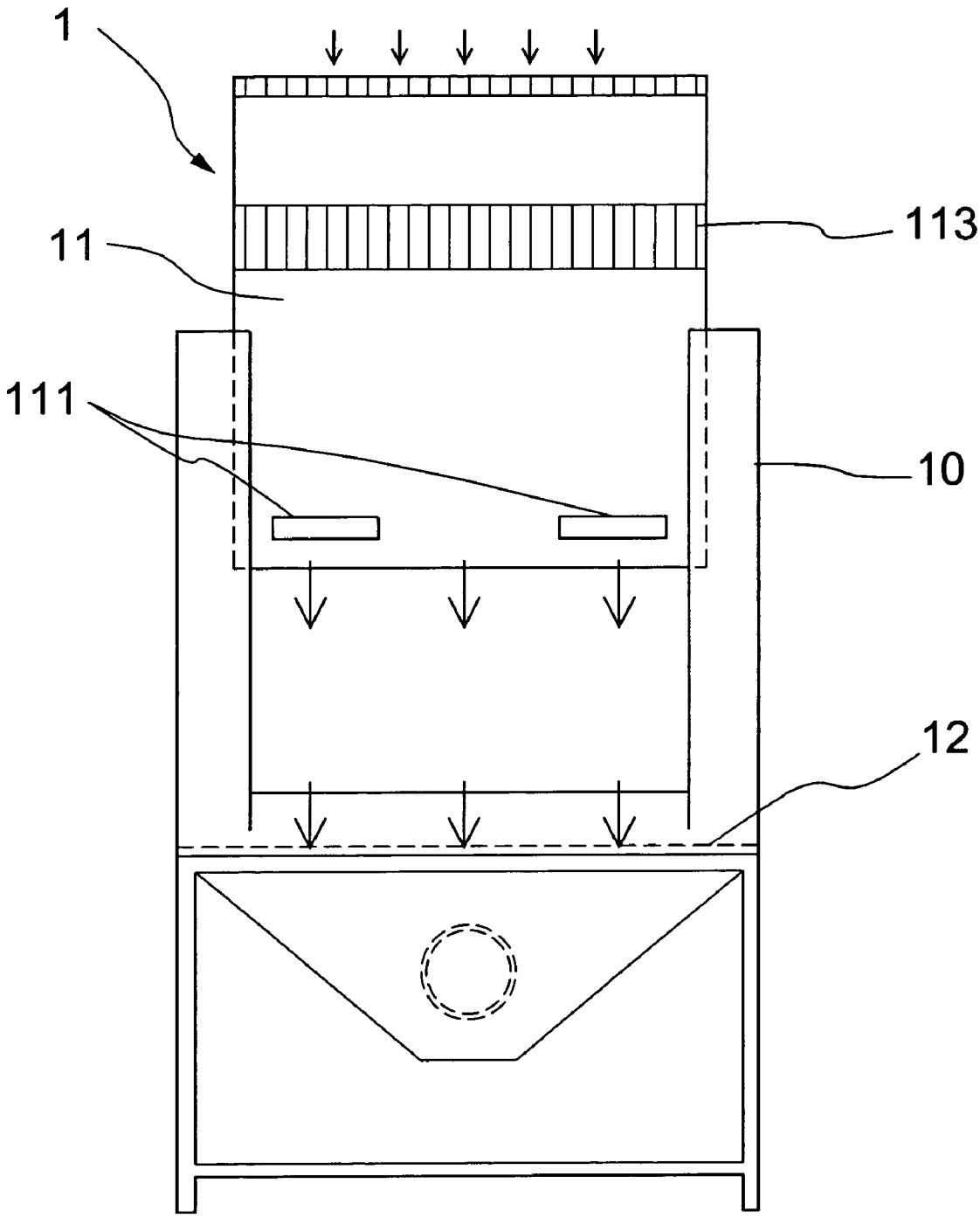
FIG. 2 is a front view showing the preferred embodiment according to the present invention.
Figure 3:
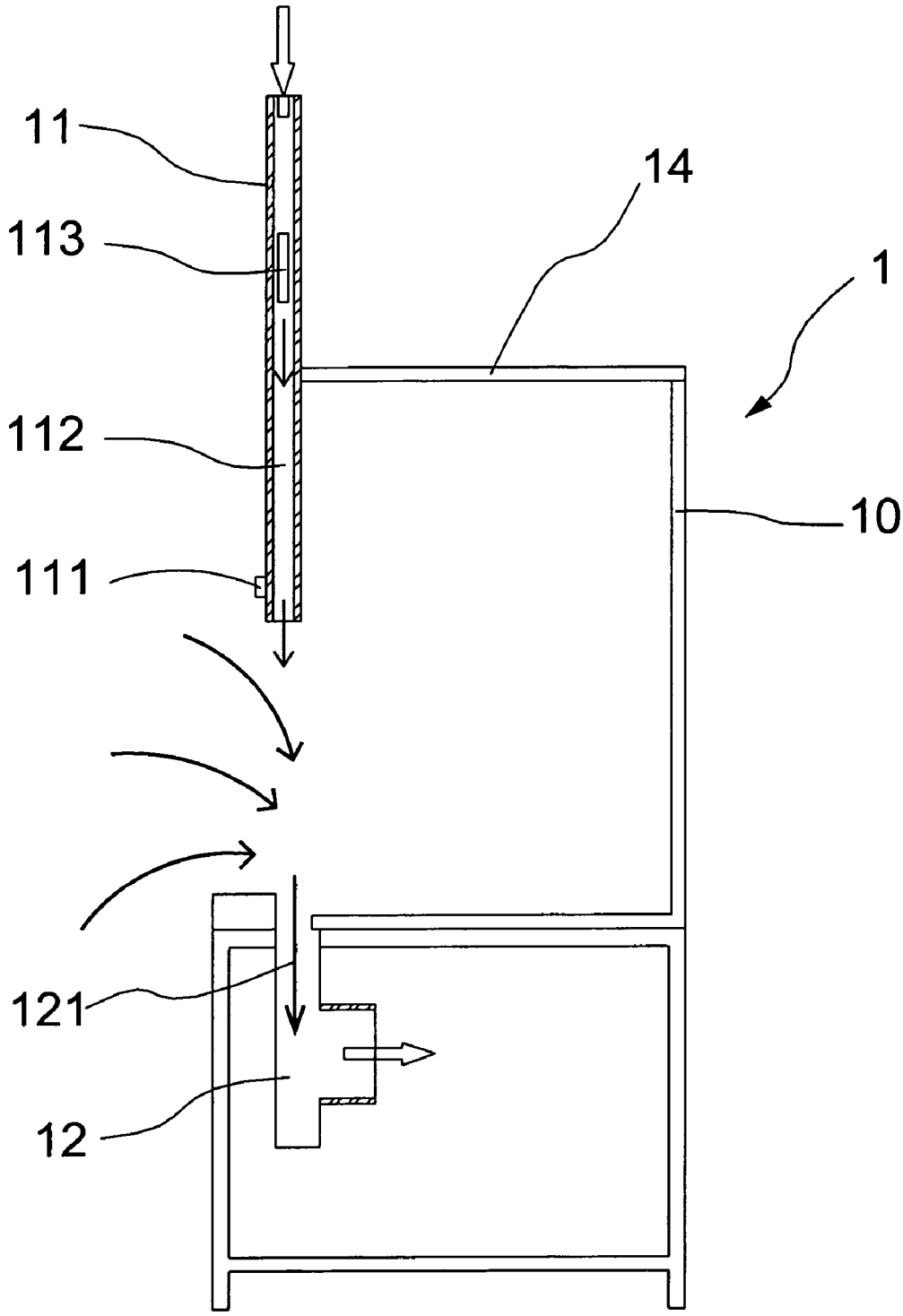
FIG. 3 is a cross-sectional showing the preferred embodiment view according to the present invention.
Figure 4:
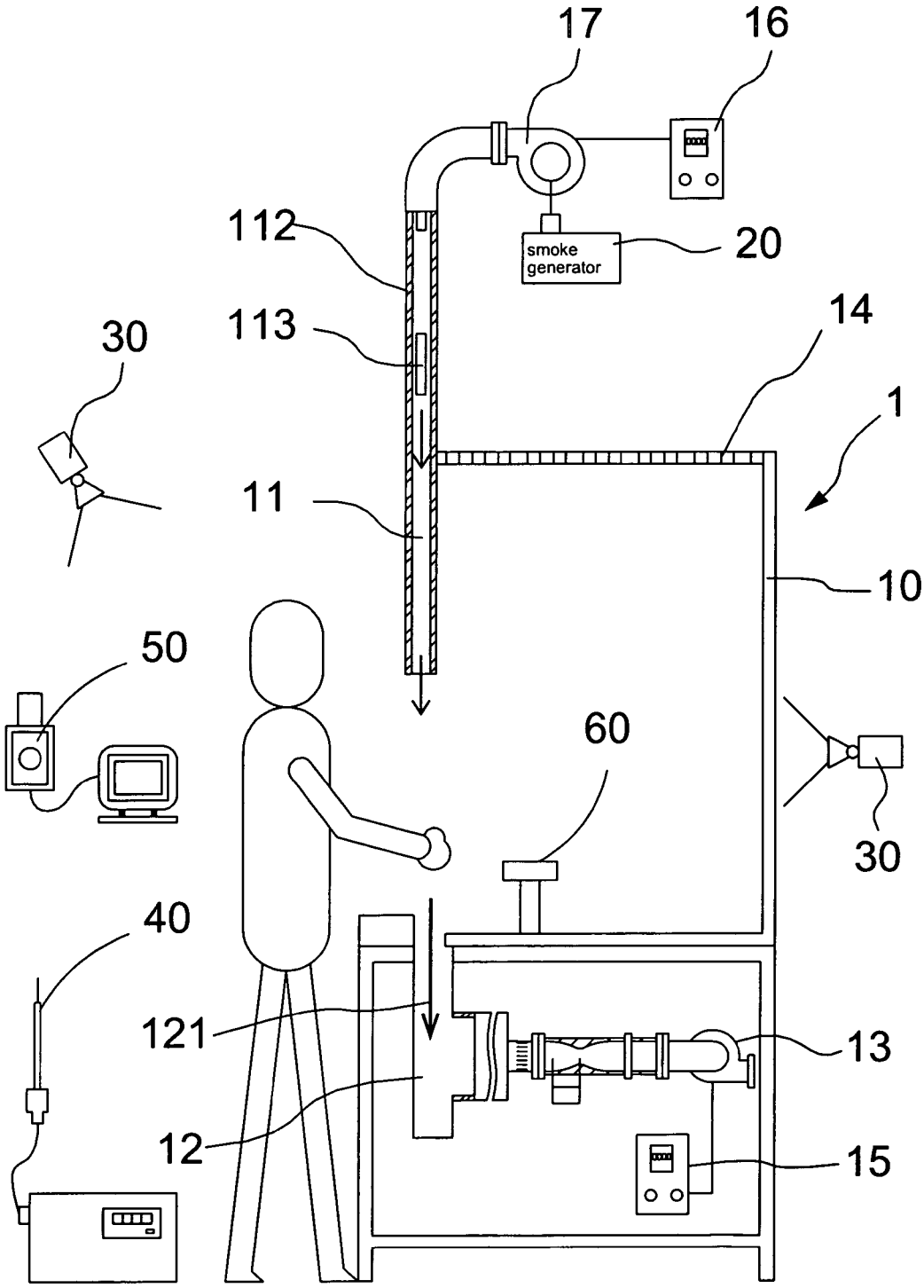
FIG. 4 is a view showing a status use of the preferred embodiment according to the present invention.

The following description(s) of the preferred embodiment (s) is/are provided to understand the features and the structures of the present invention.

Please refer to FIG. 1 through FIG. 4, which are a perspective view, a front view and a cross-sectional view showing a preferred embodiment, and a view showing a status of use of the preferred embodiment, according to the present invention. As shown in the figures, the present invention is an air-isolator fume hood, which comprises:

(a) a hood 10 having a containing space to contain pernicious gases to be exhausted, the hood having accessible spaces at the top surface and at a side surface;

(b) a sash 11 dynamically combined with the hood 10 at the side surface, the sash 11 having a handle 111 for moving the sash 11 to control the opening height of the sash 11, the sash 11 having a maximum opening height (HMax) of 60 cm (centimeter), the sash 11 having an air pipe 112, a process of supplying air by the sash 11 comprising the following steps:

(i) Supplying an air flow by an air-flow generator 17 control led by an inverter 16;

(ii) Blowing the air flow upon the air pipe 112 through a flexible tube;

(iii) Passing the airflow through a section of honeycombs 113 an the screen 14; and (iv) Blowing the air flow to an exit of the sash 11 through a stabilizing area while dissipating a part of energy from turbulence flows;

(c) an exhaust outlet 12 with a suction slot 121 deposed at the front rim of the bottom surface of the hood 10, the suction slot 121 corresponding to the air pipe 112;

(d) a blower 13 deposed at the exit end of the exhaust outlet 12 to exhaust the pernicious gases, the blower 13 having a rotation velocity controlled by an inverter 15 to change the average velocity of air (Vb) in the sash 11 and the average velocity of air (Vs) at the exhaust outlet 12, a Venturi tube 18 deposed between the blower 13 and the exhaust outlet 12 to measure exhausting velocity of air (Vs), a pressure transducer 19 deposed to coordinate with the Venturi tube to measure air pressure.

(e) a screen 14 with meshes deposing on the top of the hood 10 to supply air, the mesh having an area of 1.5 mm (millimeter)×1.5 mm surrounded by wires, the wire having a diameter of 0.3 millimeter.

Meanwhile, a smoke generator 20 is powered by a power supplier so that white candle oil in the smoke generator 20 is heated to obtain smoke; and, the smoke is compressed to be released by an air compressor. Then, the smoke in the smoke generator 20 is spread out through a smoke ejector 60 where the changes in the flow field of the smoke is observed through digital camera 50; and, an air flow velocity transducer 40 is used to measure the average velocity of air at the exit of the sash 11 and that at the screen 14.

With the above structure, an air-isolator fume hood is obtained. The characteristic of the present invention is to obtain a fume hood dynamically combined with the sash 11 having an air pipe 112 at a side. Therein, an air flow is generated by an air-flow generator 17 controlled by an inverter 16 to be blown upon the air pipe 112 through a flexible tube. After the air flow has passed through a section of honeycombs 113 and the screen 14, the air flow flows to the exit of the sash 11 through a stabilizing area while dissipating a part of energy from turbulence flows. And, by coordinately using the exhaust outlet 12, which has a suction slot 121 deposed at the front rim of the bottom surface of the hood 10 and is corresponding to the air pipe 112, an air curtain is obtained (i.e. a push-pull type air-isolator) to prevent harmful objects from spreading out. Consequently, the position for exhausting air is changed to a place close to the contaminant source so that air can be exhausted locally and efficiently. Furthermore, by deposing the screen 14 on the top of the hood 10, the physical principle of air suction together with air supply is conformed. Hence, the air-isolator fume hood obtains characteristics of a mechanism of air suction together with air supply, a better local air suction at a place close to the contaminant source, an energy saving, and an efficient pernicious-gas exhausting.

Please refer to FIG. 5 through FIG. 8, which are views showing regions of flow field modes of the preferred embodiment according to the present invention. On using the present invention, the flow field inside the hood 10 is described as follows:

A contaminant is simulated with a smoke (obtained by a smoke generator 20) released from the sash 11, where the opening height of the sash 11 (H) is equal to the maximum opening height (H Max, which is 60 cm) (H/Hmax=1) and a laser sheet is obtained by a laser sheet generator 30. When the velocity of air for exhausting (Vs) is 12 m/s (meter per second) and the velocity of air for blowing (Vb) is 2 m/s, an air curtain formed at the sash 11 tends to curve inwardly, where, as the air flow flows near the exhausting end, it is pulled downwardly and is not turned into or out of the hood. When Vs is 12 m/s and Vb is 5 m/s, owing to the faster Vb than that for the previous case, the air curtain is straight without tending to curve inwardly. When Vs is 6 m/s and Vb is 1 m/s, the air flow of the air curtain is turned into the hood forming obvious circulations. And, When Vs is 12 m/s and Vb is 6 m/s, the air curtain is straight yet with obvious circulations formed in the hood.

Then, the opening height of the sash 11 is shut to three fourth of the maximum opening height (H/H Max=¾). When Vs is 12 m/s and Vb is 2 m/s, the air curtain tends to curve inwardly, where, as the air flow flows near the exhausting end, it is pulled downwardly and is not turned into or out of the hood. When Vs is 12 m/s and Vb is 5 m/s, owing to the faster Vb than that for the previous case, the air curtain is straight with out tending to curve inwardly. When Vs is 3 m/s and Vb is 1 m/s, the air flow of the air curtain is turned into the hood forming obvious circulations. And, When Vs is 3 m/s and Vb is 5 m/s, the air curtain is straight yet with obvious circulations formed in the hood.

Again, the opening height of the sash 11 is shut to a half of the maximum opening height (H/H Max=½). When Vs is 12 m/s and Vb is 1 m/s, the air curtain tends to curve inwardly, where, as the air flow flows near the exhausting end, it is pulled downwardly and is not turned into or out of the hood. When Vs is 6 m/s and Vb is 4 m/s, owing to the faster Vb than that for the previous case, the air curtain is straight without tending to curve inwardly. When Vs is 1 m/s and Vb is 0.5 m/s, the air flow of the air curtain is turned into the hood forming obvious circulations. And, When Vs is 1 m/s and Vb is 3 m/s, the air curtain is straight yet with obvious circulations formed in the hood.

At last, the opening height of the sash 11 is shut to one fourth of the maximum opening height (H/H Max=¼). When Vs is 12 m/s and Vb is 2 m/s, the air curtain tends to curve inwardly, where, as the air flow flows near the exhausting end, it is pulled downwardly and is not turned into or out of the hood. When Vs is 6 m/s and Vb is 5 m/s, owing to the faster Vb than that for the previous case, the air curtain is straight without tending to curve inwardly. When Vs is 0.8 m/s and Vb is 1 m/s, the air flow of the air curtain is turned into the hood forming obvious circulations. And, When Vs is 0.8 m/s and Vb is 3 m/s, the air curtain is straight yet with obvious circulations formed in the hood.

To sum up with the above four opening height, different operational velocities of air determine whether circulations occur or not. Hence, according to the flow field modes, when using the air-isolator fume hood according to the present invention, the velocity of air has to be adjusted to a void circulations.

The following description shows flow fields near the sash 11 under different velocities of air:

When H/H max=1 and Vs is 13.7 m/s and Vb is 3 m/s, no circulation occurs and no flow shows near doorsill. When Vs is 3 m/s and Vb is 6 m/s, the flow field is straight yet circulations occur and flows show near the doorsill.

When H/H max=¾and Vs is 12 m/s and Vb is 2 m/s, no circulations occur and no flow shows near the doorsill. When Vs is 6 m/s and Vb is 4.5 m/s, the flow field is straight yet circulations occur and flows show near the doorsill.

When H/H max=½and Vs is 12 m/s and Vb is 3 m/s, no circulation occurs and no flow shows near doorsill. When Vs is 6 m/s and Vb is 3.8 m/s, the flow field is straight yet circulations occur and flows show near doorsill.

When H/Hmax=¼and Vs is 12 m/s and Vb is 3 m/s, no circulation occurs and no flow shows near the doorsill. When Vs is 3 m/s and Vb is 2.6 m/s, the flow field is straight yet circulations occur and flows show near the doorsill.

According to the above four flow fields near the doorsill, not matter what the opening height is, circulations may occur in the hood and at the doorsill under different velocities of air. Even when the flow field is straight, circulations may occur near the doorsill. Thus, according to the flow field near the doorsill, when using the air-isolator fume hood according to the present invention, the velocity of air has to be adjusted to avoid circulations.

Regarding the adjustment of the velocity of air, the different flow fields occurred may be confusing, so that a systematic flow field module has to be figured out to clarify the flow fields with areas of characteristics for the air-isolator fume hood.

When determining the flow field module, the modes of the flow fields and its velocities of air observed by using a technology of visualization are recorded for dividing regions of modes. There are four main regions of modes for the flow fields: they are the regions for concave curtain mode 70, straight curtain mode 71, under-suction mode 72 and over-blow mode 73. And, the environment for determining these different flow field modes includes a screen on the ceiling of the hood, a suction slot at the front bottom rim and a smoke released by the sash 11.

Among these four modes, the concave curtain mode 70 is the best operational mode, where, owing to the negative pressure in the hood and the air flow going down at the front, the air curtain is curved. When the flow is approaching the doorsill, it is pulled by the pulling force of the suction slot 121 to keep from spreading outside. That is to say, when Vb and Vs are adjusted to obtain the con cave curtain mode 70, the contaminant is prevented from leakage, whose protection is better than that of a common downdraft fume hood.

Among the other three modes, the straight curtain mode 71 is a mode with a faster velocity of air than that of the con cave curtain mode 70. Circulations in the hood under this kind of flow field seldom occur owing to the strong pulling force of the suction slot; yet turbulence flows will occur around the doorsill and the sash 11 owing to the faster Vb. Even the flow from the sash 11 is of fresh air, the turbulence flows at the doorsill and those out of the sash 11 may make the contaminant leak out of the hood by way of those turbulence flows to fail the protection by the air curtain.

In the under-suction mode 72, the pulling force is weaker so that circulations occur in the hood. The contaminant gradually fills the hood by the circulations and later is spread outside from the ceiling of the hood or the opening at the sash.

The over-blow mode 73 is a mixture of the straight curtain mode 71 and the under-suction mode 72. Owing to the weak pulling force and the over-blow, circulations occur seriously in the hood, out of the sash and at the doorsill, which makes the fume hood lack of safety for having many circulations leaking contaminant.

Figure 5:
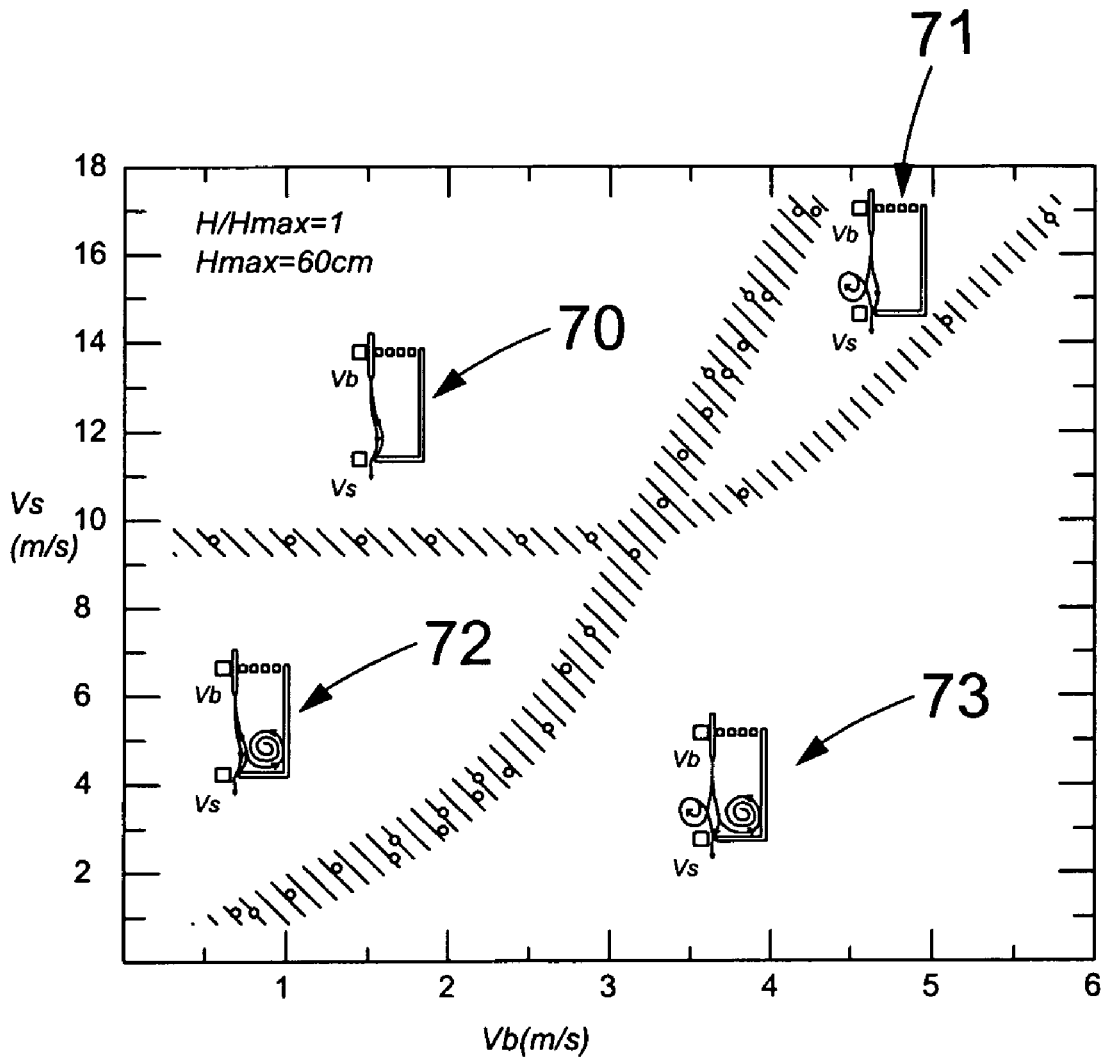
FIG. 5 through FIG. 8 are views showing regions of flow field modes of the preferred embodiment according to the present invention.
Figure 6:
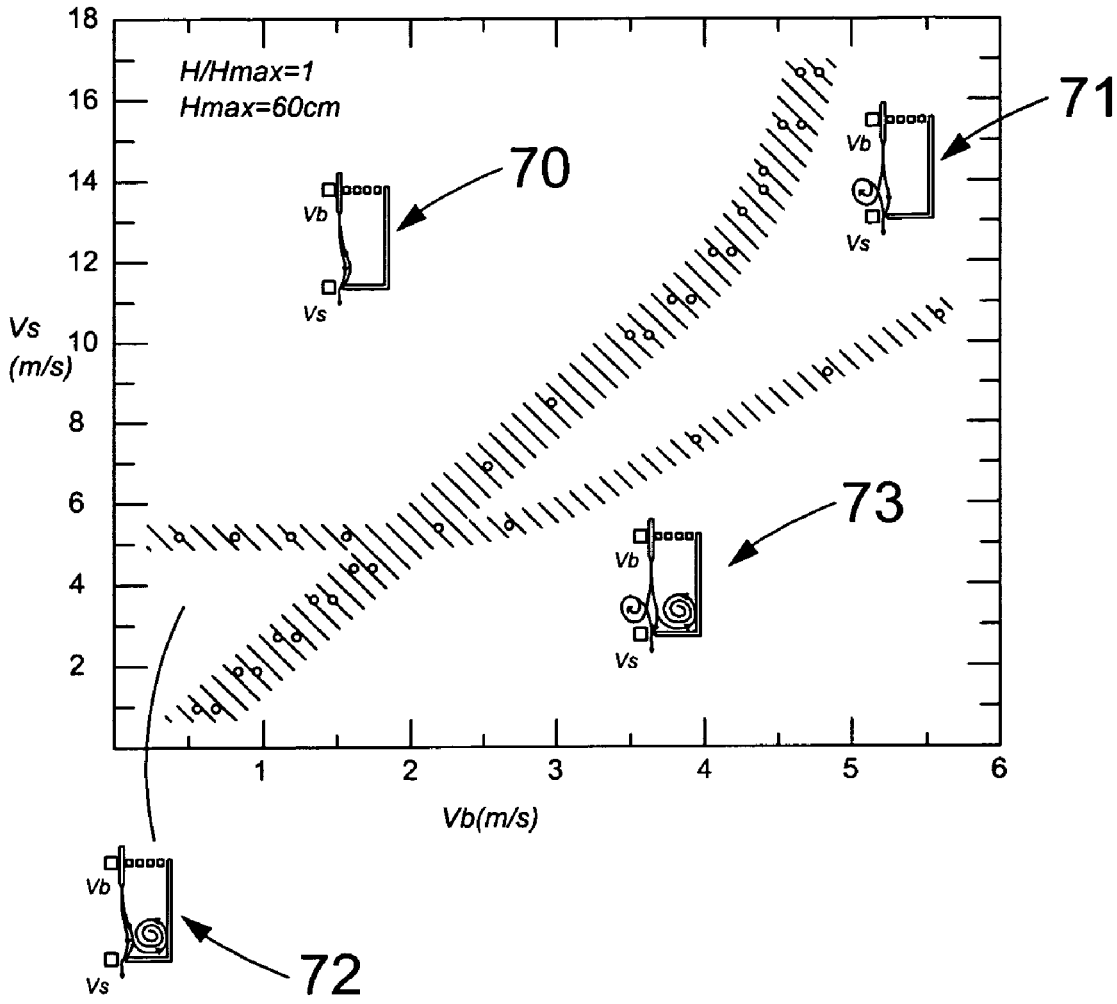
Figure 7:
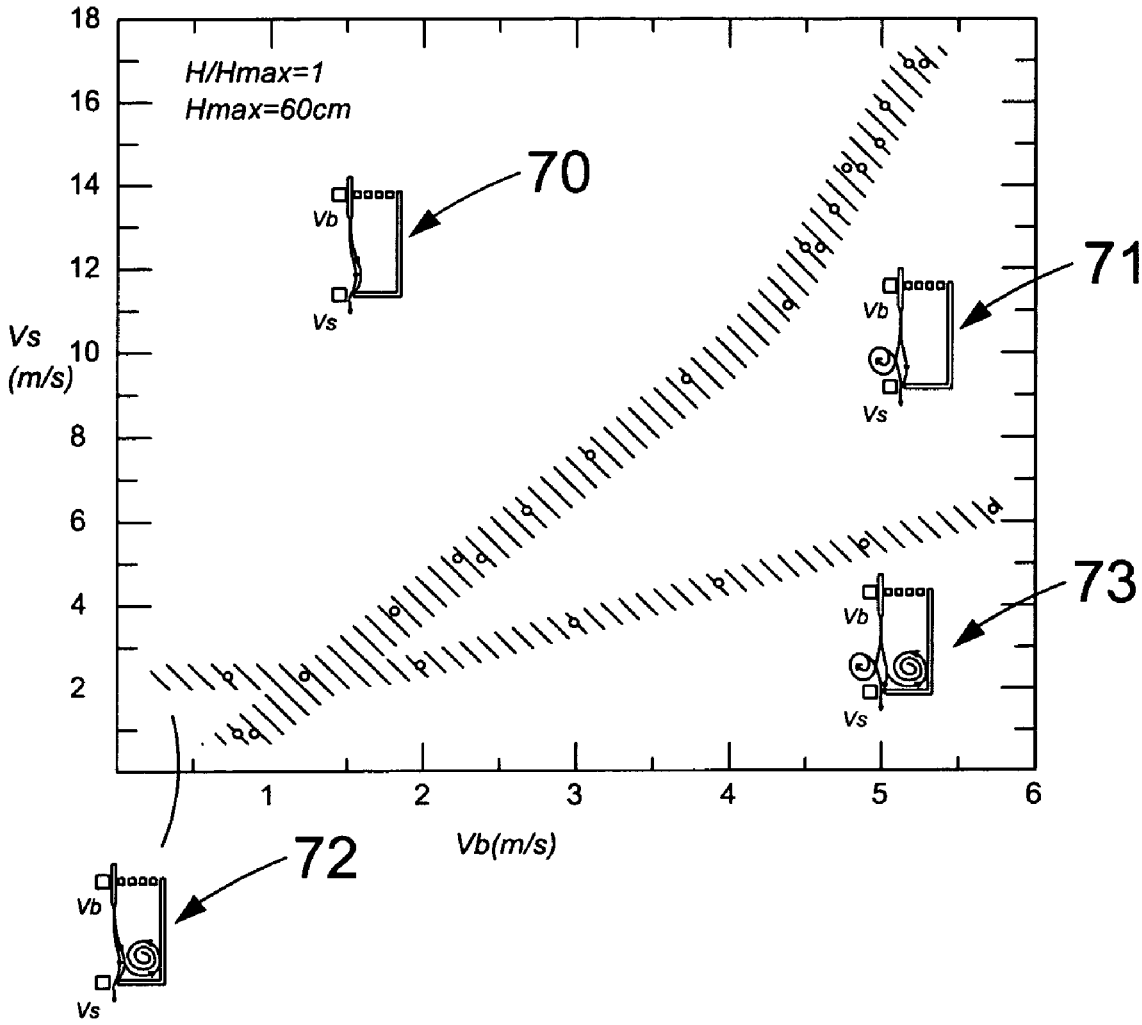
Figure 8:
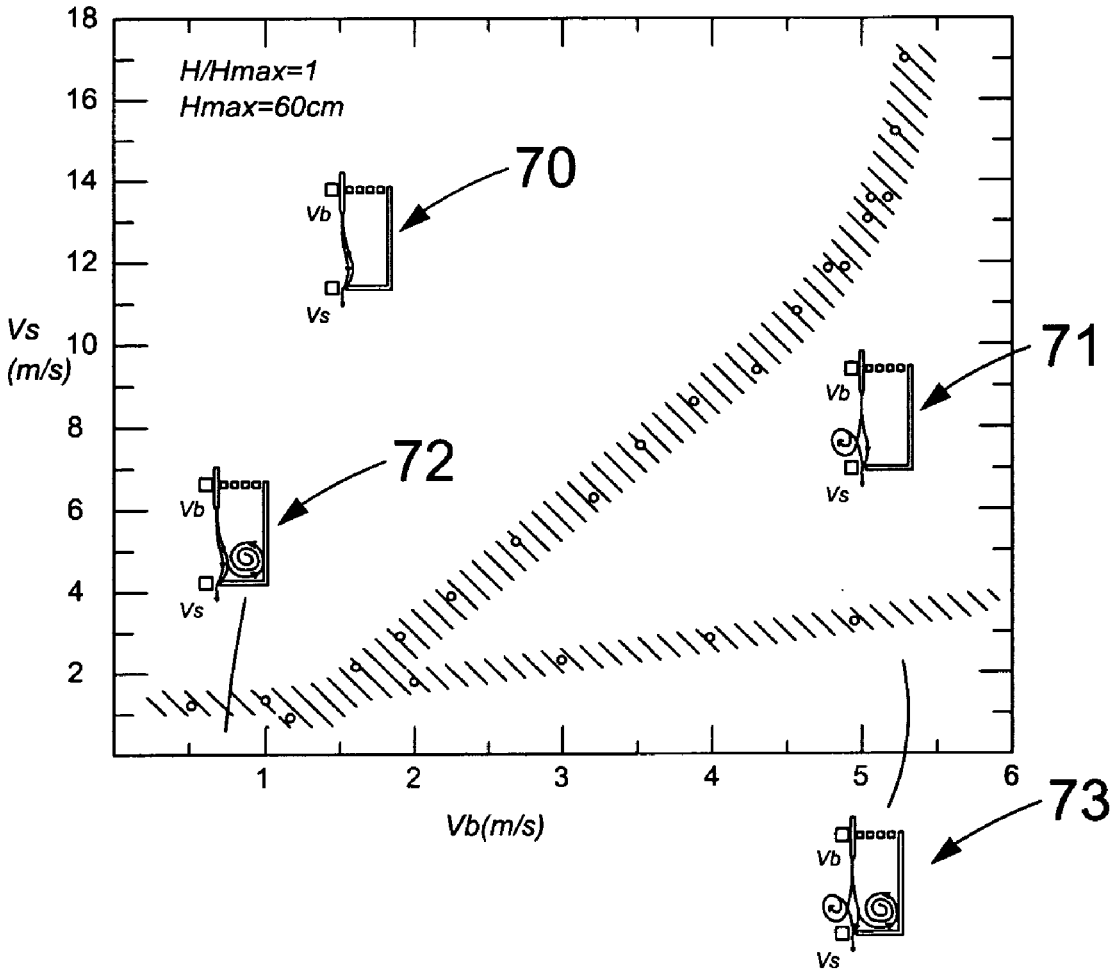
Figure 9:
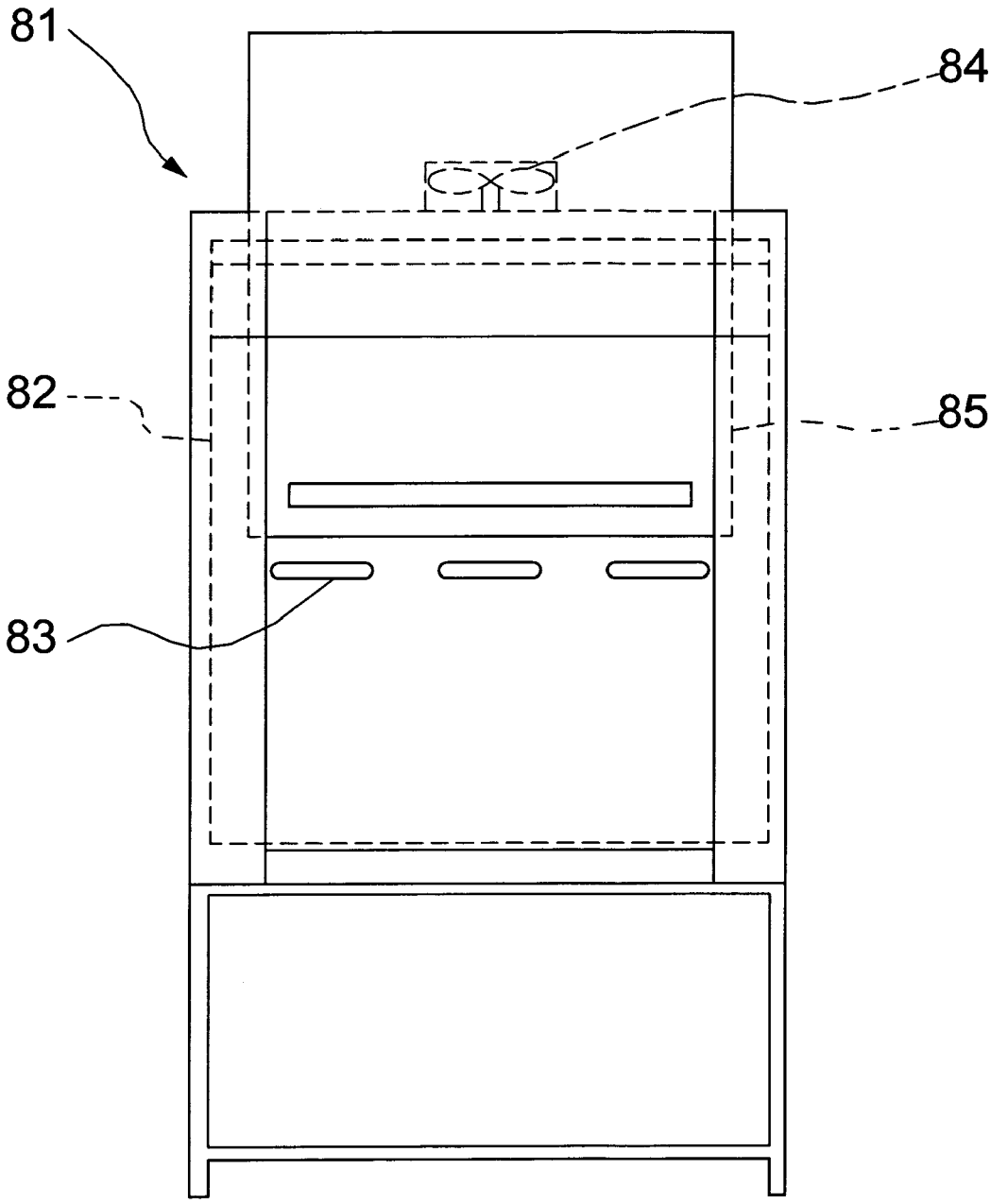
FIG. 9 (Prior Art)
FIG. 9 is a front view showing a preferred embodiment according to a prior art.
Figure 10:
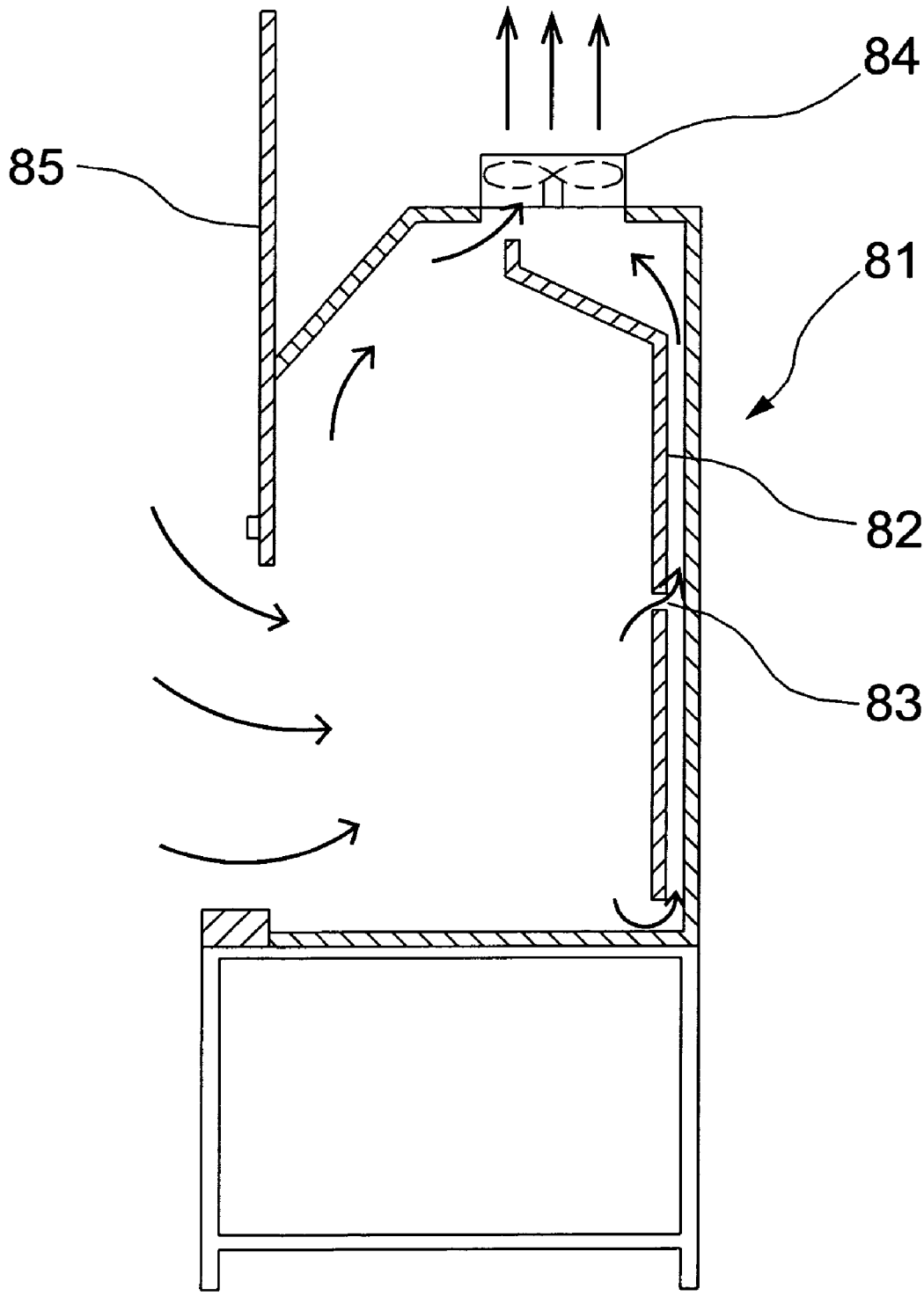
FIG. 10 (Prior Art)
FIG. 10 is a cross-sectional view showing the preferred embodiment according to the prior art.

FIG. 5 through FIG. 8 are views showing modes of flow fields with various velocities of air and various opening height, which are references for operating the air-isolator fume hood according to the present invention. In the figures, a thick line and a thin line indicate boundaries to divide regions for different modes. When H/H max=1, the region for the concave curtain mode 70 at the upper left corner of FIG. 5 shows that Vs is better to be above 10 m/s to be safe in operation. Yet, as Vb is increased to 3.2 m/s, Vs has to be increased after Vb.

The two boundary lines divide four regions of modes; and each line can be used to determine the flow fields formed under various velocities of air. The thick line can be used to determine whether the flow will be flown out of the hood, which can be used to adjust and control the velocity of air for blowing; and the thin line can be used to determine whether there will be circulations occurred in the hood, which can be used to adjust and control the velocity of air for exhausting. By referencing to these two lines, energy can be saved by preventing keep making an even bigger fume hood.

Furthermore, by referring to the four figures of FIG. 5 through FIG. 8, as the opening height is getting lower, the distance between the blowing end and the exhausting end is getting closer too, together with lower speed boundary. That is to say, as the opening height is getting lower, the Vs can be reduced while preventing circulations from occurring in the concave curtain mode 70, so that energy can be saved at the exhausting end.

To sum up with the above four flow field modes of air curtains together with the regions, the regions for the con cave curtain mode 70 is suggested to be used for determining the velocities of air for blowing and exhausting while using the air-isolator fume food according to the present invention.

As a summary, the present invention is an air-isolator fume hood with a blowing end at the sash and an exhausting end at the front rim of the bottom surface to exhaust contaminant while efficiently preventing contaminant from leakage.

The preferred embodiment(s) herein disclosed is/are not intended to unnecessarily limit the scope of the invention. Therefore, simple modifications or variations belonging to the equivalent of the scope of the claims and the instructions disclosed herein for a patent are all within the scope of the present invention.

What is claimed is:

1. An air-isolator fume hood comprising:

a) a hood having:

i) a containing space for a pernicious gas to be exhausted; and ii) an opening located in a side surface;

b) a sash adjustably connected to the hood and selectively adjusting a height of the opening, the sash having an air pipe extending through an interior thereof and providing an input air, the sash is movable between closed and open positions;

c) an exhaust outlet having a suction slot connected to the hood and communicating with the containing space, the suction slot is located on a bottom of the opening below the air pipe of the sash;

d) a blower connected to an exit end of the exhaust outlet and exhausting the pernicious gas; and e) a screen located on a surface of the hood for supplying air, wherein the input air flowing through air pipe of the sash and an air supply flowing through the screen are flowing simultaneously with an exhaust air withdrawn by the blower, wherein the blower forming an air curtain and preventing the pernicious gas from being exhausted through the opening, wherein the air pipe of the sash communicating with the exhaust outlet and providing the input air when the sash is located in the open position, the closed position, and any position there between.

2. The air-isolator fume hood according to claim 1, wherein the sash has a handle for selectively moving the sash between the closed and open positions.

3. The air-isolator fume hood according to claim 1, wherein a maximum height of the opening is 60 centimeters.

4. The air-isolator fume hood according to claim 1, further comprising an invertor controlling a rotational velocity of the blower and selectively adjusting an exhausting velocity of air, an average velocity of air flow through the opening, and an average velocity of air through the exhaust outlet.

5. The air-isolator fume hood according to claim 1, wherein the screen has a plurality of meshes, each of the plurality of meshes has an opening surrounded by wire, the opening is 1.5 millimeters by 1.5 millimeters, and the wire has a diameter of 0.3 millimeters.

6. The air-isolator fume hood according to claim 1, further comprising a Venturi tube and a pressure transducer located between the blower and the exhaust outlet, the Venturi tube measuring an exhausting velocity of the exhaust air and the pressure transducer measure an air pressure.

7. The air-isolator fume hood according to claim 1, wherein the air pipe of the sash has a honey-comb section.

* * * * *